US005664276A

United States Patent [19]

Arias

[11] Patent Number: 5,664,276

[45] Date of Patent: Sep. 9, 1997

[54] BRUSH-TYPE SWEEPER

[76] Inventor: Saturnino Nunez Arias, Carretera Caboalles, 332, 24191 Villabalter, Spain

[21] Appl. No.: 649,818

[22] Filed: May 17, 1996

[30] Foreign Application Priority Data

May 18, 1995 [ES] Spain ..... 9501324

[51] Int. Cl.[6] ..... A47L 11/32

[52] U.S. Cl. ..... 15/42; 15/41.1; 15/44

[58] Field of Search ..... 15/23, 27, 41.1, 15/42, 44, 46, 48.1, 25, 39.5

[56] References Cited

U.S. PATENT DOCUMENTS

| | | | |
|---|---|---|---|
| 920,209 | 5/1909 | Stevens | 15/42 |
| 3,879,788 | 4/1975 | Cousin | 15/42 |
| 3,978,539 | 9/1976 | Yonkers | 15/42 |
| 4,007,508 | 2/1977 | Ooyachi | 15/42 |
| 4,845,797 | 7/1989 | Kobayashi | 15/41.1 |

*Primary Examiner*—David Scherbel
*Assistant Examiner*—Terrence Till
*Attorney, Agent, or Firm*—Ostrolenk, Faber, Gerb & Soffen, LLP

[57] ABSTRACT

A brush-type sweeper unit includes a prism-like body that has a base with an open front part, an open front face, and an upper face provided by a removable cap from which a handle for moving the sweeper unit extends. The body also includes parallel sidewalls between which first, second and third shafts extend, with the second shaft being between the first and third shafts. Front and rear cylindrical brushes are mounted on the respective first and second shafts, and a set of front wheels are also mounted on the first shaft at opposite ends thereof. Mounted on the third shaft are a set of rear wheels that are in edge-to-edge frictional engagement with a set of driven wheels on the second shaft. In this way the rear brush is driven by rotation of the rear wheels transmitted through the driven wheels, with rotation of the rear brush being in a direction opposite to the rotational direction of the front brush. As the sweeper unit moves forward, dirt particles are lifted between the brushes and delivered to the interior of the body with the latter providing a storage container for dirt particles lifted by the brushes. Projecting forward from opposite sides of the body are diverging short brush units, with bristles of one brush unit facing the bristles of the other brush unit.

2 Claims, 2 Drawing Sheets

BRUSH-TYPE SWEEPER

FIELD OF INVENTION

The present invention relates to an improved brush-type sweeper used primarily in the home for lifting and collecting particles of dirt.

1. Prior Art

At present there are a number of brush-type sweeper units for lifting dirt particles from a surface and accumulating such particles in a container that has an openable cover to facilitate emptying of the container. Many of these sweeper units embody somewhat sophisticated constructions comprising many components joined by complicated couplings.

2. Background of the Invention

In accordance with the instant invention, a sweeper unit of simplified construction is provided without sacrificing cleaning performance or safety. Such simplified construction includes three parallel horizontal shafts which extend transversely through a prism-like body that provides a container to accumulate particles swept from a supporting surface for the sweeper unit by two cylindrical rotating brushes. The first and second of these brushes are mounted on the respective first and second ones of the parallel shafts with first and rear sets of sweeper support wheels being mounted on the respective first and third ones of the parallel shafts. Mounted on the second shaft is a set of intermediate wheels in edge-to-edge frictional engagement with the rear set of wheels to be rotated by the latter in a direction opposite to the rotational direction of the sweeper support wheels. In this way the cylindrical brushes are caused to rotate in opposite directions and in so doing lift dirt particles therebetween and deliver such particles to a container within the sweeper body where they accumulate until the container is emptied by removing the cap-like upper wall of the body.

While the sweeper unit is intended to be propelled by an operator, a small motor may be incorporated to drive the front and/or rear wheels, and thereby making the sweeper unit self-propelled.

SUMMARY OF THE INVENTION

Accordingly, the primary object of this invention is to provide a novel simplified construction for a brush-type sweeper unit.

Another object is to provide a sweeper unit of this type that is economical to produce and inexpensive to service.

Still another object is to provide a sweeper unit of this type that is reliable over a long operating life.

A further object is to provide a sweeper unit of this type that is simple to operate.

These objects as well as other objects of this invention shall become readily apparent after reading the following description of the accompanying drawings in which:

DETAILED DESCRIPTION OF THE INVENTION

Figure 1:
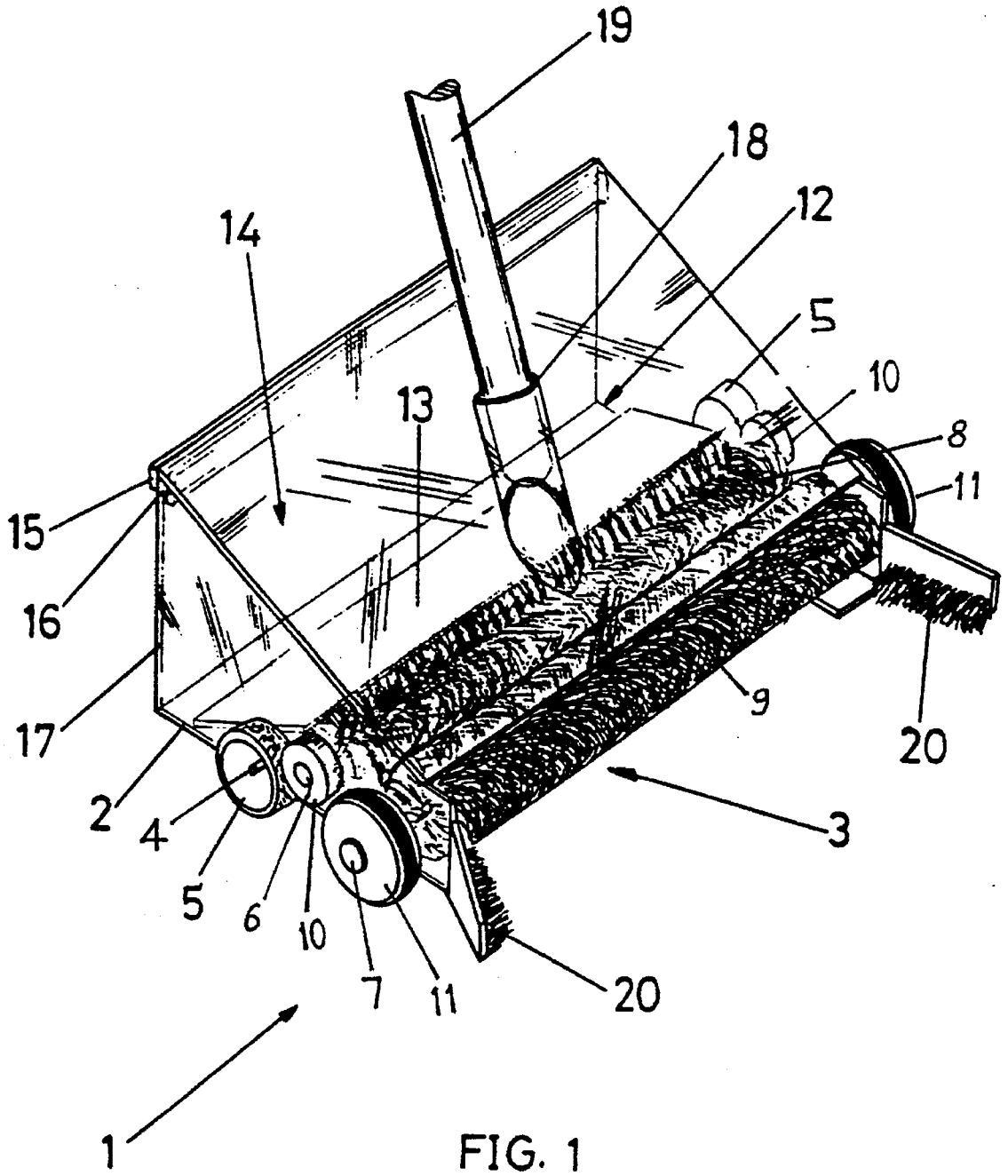
FIG. 1 is a perspective of a sweeper unit constructed in accordance with teachings of the instant invention.
Figure 2:
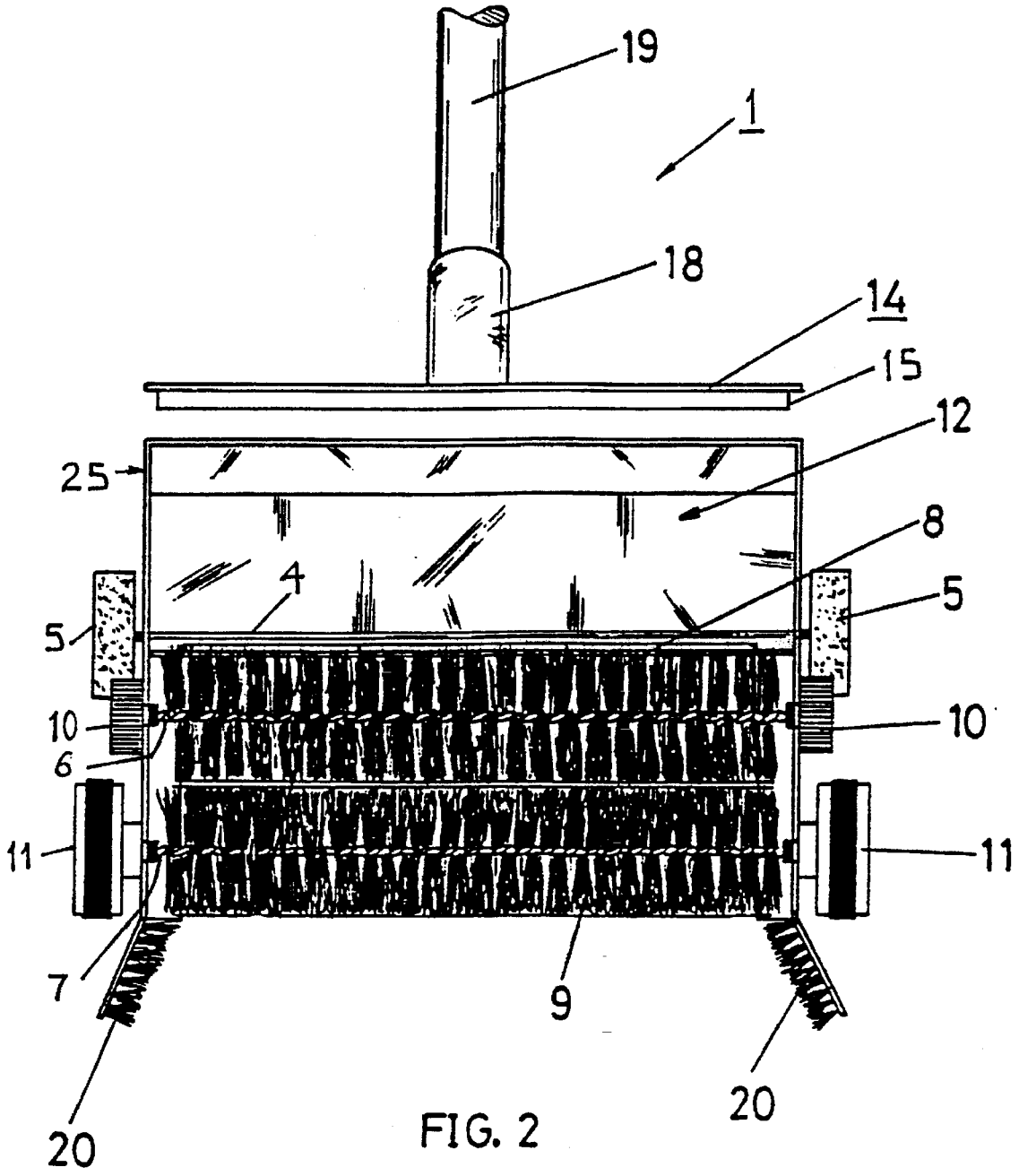
FIG. 2 is a top view of the sweeper shown in FIG. 1 with the removable cap thereof separated from the sweeper body.

Now referring to the drawings, sweeper 1 comprises prism-like body 25 that is open at its frontal part 3 and is open at the front portion of base 2. Body 25 also includes rear wall 17 and closed vertical sides, as well as an upper part in the form of cap 14 removably connected to upper edge 16 of rear wall 17 by coupling channel 15 on cap 14. Cap 14 also mounts an inclined central stub sleeve 18 which receives the lower end of handle or grip 19 used by an operator to push and pull sweeper 1.

Three horizontal parallel shafts 4, 6 and 7 extend transversely through body 20. Shaft 6 is between shafts 4 and 7 while shaft 4 is behind shaft 7. The ends of all three shafts 4, 6 and 7 project beyond both sidewalls of body 25 where drive wheels 5, 5 are mounted on shaft 4 at opposite ends thereof, driven intermediate wheels 10, 10 are mounted on shaft 6 at opposite ends thereof and drive wheels 11, 11 are mounted on shaft 7 at opposite ends thereof. Wheels 10, 10 are keyed to shaft 6 to rotate therewith while wheels 11, 11 are keyed to shaft 7 to rotate therewith. Cylindrical brushes 8, 9 are mounted on respective shafts 6, 7 to rotate therewith, with shafts 6, 7 constituting the central axes for respective brushes 8, 9.

The circular edges of rear wheels 5, 5 are rubber covered and are frictionally engaged with the roughened circular edges of intermediate wheels 10, 10 that are biased thereagainst. Thus, rotation of wheels 5, 5 is transferred through wheels 10, 10 and shaft 6 to rotate rear brush 8 in a direction opposite to the rotational direction of front brush 9 that is driven by front wheels 11, 11 through shaft 7. While front and rear wheels 11, 5 engage the sweeper supporting surface (not shown) that is being cleaned by sweep unit 1, intermediate wheels 10 do not engage that surface. Brushes 8 and 9 rotate in opposite directions with the bristles thereof engaging the sweeper supporting surface so that when sweeper unit 1 moves forward, dirt removed by brushes 8, 9 is raised between them, with such dirt being delivered rearward by rear brush 8 and deposited in container 12 located inside of body 25. Container 12 is at the rear of base 2 and is partly defined by inclined plate 13 within body 25. There is a shallow pool of water in container 12 to prevent dust and other dirt particles from being dispersed into the air.

An individual short brush 20 extends forward from each side of body 25, with the bristles of the respective brushes facing one another. Each brush 20 is inclined outward in a forward direction to provide a tapering mouth leading rearward toward front brush 9.

The size of the sweeper unit is dictated by its intended use such as clearing particles from a table, carpet, furniture, etc.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A sweeper unit comprising:

a prism-like body including an open front, a base having a front section that is open, a handle, a removable cap above said base to support said handle extending upward from said cap, and parallel sidewalls extending upward from said base;

adjacent front and rear cylindrical brushes supported for rotation on respective first and second axes that extend parallel to said base and through said sidewalls, with said front brush being at said open front and said rear brush being at said front section;

front wheels rotatable on said first axis to rotate said front brush;

rear wheels at opposite ends of a third axis parallel to said first and second axes;

additional wheels rotatable on said second axis and drivingly connected to said rear brush;

said front wheels and said rear wheels being adapted to support said sweeper unit on a surface to be cleaned thereby while said additional wheels are clear of such surface;

said additional wheels being engaged with said rear wheels to be frictionally driven by said rear wheels in a direction opposite to which said front wheels are rotating whereby said front and rear brushes rotate in opposite directions to lift dirt particles between said brushes as said sweep unit moves forward.

2. A sweeper unit as defined in claim 1 also comprising first and second relatively short flat brushes having bristles facing one another; each of said flat brushes extending forward from an individual one of said sidewalls and being inclined outward with respect thereto.

* * * * *